US012264557B2

(12) United States Patent
Burke et al.

(10) Patent No.: US 12,264,557 B2
(45) Date of Patent: Apr. 1, 2025

(54) REVERSE CIRCULATOR AND METHOD

(71) Applicant: CONOCOPHILLIPS COMPANY, Houston, TX (US)

(72) Inventors: Jason Burke, Houston, TX (US); John G. Eller, Houston, TX (US); Matthew L. White, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 199 days.

(21) Appl. No.: 17/821,287

(22) Filed: Aug. 22, 2022

(65) Prior Publication Data

US 2023/0078999 A1 Mar. 16, 2023

Related U.S. Application Data

(60) Provisional application No. 63/242,239, filed on Sep. 9, 2021.

(51) Int. Cl.
*E21B 34/14* (2006.01)

(52) U.S. Cl.
CPC ..... *E21B 34/14* (2013.01); *E21B 2200/06* (2020.05)

(58) Field of Classification Search
CPC ..... E21B 21/103
See application file for complete search history.

(56) References Cited

U.S. PATENT DOCUMENTS

| | | | | |
|---|---|---|---|---|
| 2,143,251 | A * | 1/1939 | Savitz | C09K 8/72 166/73 |
| 2,327,610 | A * | 8/1943 | Savitz | E21B 34/12 166/240 |
| 6,182,766 | B1 * | 2/2001 | Rogers | E21B 21/103 166/185 |
| 9,708,872 | B2 | 7/2017 | O'Neal et al. | |
| 2004/0112588 | A1 | 4/2004 | Mullins | |
| 2005/0217864 | A1 | 10/2005 | Carmichael | |
| 2011/0030975 | A1 | 2/2011 | Duphorne | |
| 2012/0160568 | A1 | 6/2012 | Bottos et al. | |
| 2020/0386067 | A1 | 12/2020 | Dubuc et al. | |

FOREIGN PATENT DOCUMENTS

WO 2014025797 2/2014

OTHER PUBLICATIONS

International Search Report and Written Opinion for Application PCT/US2022/041027.

* cited by examiner

*Primary Examiner* — Cathleen R Hutchins
(74) *Attorney, Agent, or Firm* — Boulware & Valoir PLLC

(57) ABSTRACT

Gravity driven reverse circulator tools are provided and methods of using same. One tool has nested pipes that when fully nested close a hole in one of the pipes, but when the drillstring is lifted, the pipes partially separate under the force of gravity to expose the hole. The other embodiment is similar, but the hole is hook shaped (hook on top as in a walking cane) and a protrusion from the other pipe fits in the hole. Thus, both lifting and rotation are needed open the tool.

3 Claims, 14 Drawing Sheets

Types of Drill Pipe Tool Joints

REVERSE CIRCULATOR AND METHOD

CROSS-REFERENCE TO RELATED APPLICATIONS

This application claims priority to U.S. Ser. No. 63/242,239, filed Sep. 9, 2021, and incorporated by reference in its entirety for all purposes.

FEDERALLY SPONSORED RESEARCH AND DEVELOPMENT

Not applicable.

PRIOR ART

This disclosure generally relates to tools and methods used to clean out wellbores, in particular to a reverse circulator tool and method of using same.

BACKGROUND OF THE INVENTION

Oil and gas wells are typically drilled with a fluid driven motor and drill bit affixed to the lower end of a drillpipe. Drilling fluid is pumped down through the drillpipe by pumps situated at the surface of the drillstring. As the drilling fluid enters the motor, it travels through a spiral channel which imparts rotation to the drill bit as the fluid impacts the channel. After passing through the motor and drill bit, the drilling fluid travels back up the annulus of the wellbore around the drillstring, carrying drilling cuttings with it, so they can be removed at the surface and the drilling fluid reused.

Cuttings do not always return to the surface, however, and they are subject to build up, and can eventually stop fluid flow and lead to expensive repairs. In vertical wells there are two velocity vectors acting in opposite direction on cutting particles, gravity pulling downward and flow velocity pushing upward. Whenever the fluid velocity exceeds gravity effects on the cuttings (working together with buoyancy effects caused by density differences), drill cuttings in the vertical annulus are more likely to be transported out of the hole. If the fluid doesn't move fast enough, or if the cuttings are heavier, there will be a build of debris in the well.

The problem is greatly exacerbated in horizontal wells, where the gravity is now perpendicular to fluid flow and there is a very limited distance to fall, resulting in debris bed formation on the low side of the annulus almost immediately. Cutting beds greatly increase drag in a horizontal well, hindering the drillpipe from sliding, and can limit the possible lateral borehole extension by hundreds of feet. Cuttings accumulation also oppose the rotation of the drillpipe and greatly reduce the amount of torque delivered near the bit. Torque and drag losses are the most important factors that can disturb drilling horizontally; they reduce the penetration rate by preventing the proper weight transfer to the bit; they limit the length of the drain section by reaching the maximum rig capabilities; they induce wear, twist off, and over torque to the drilling equipment and make casing or liner run impossible.

In order to clean out the well, both during drilling and while in production, the fluids may be reverse circulated for a period of time. In reverse circulation, the surface pump used to circulate the drilling fluid through the drillstring and into the surrounding annulus (i.e., forward circulation), is instead used to pump the drilling fluid first into the annulus and then into the drillstring at a location at or near the bottom of the drillstring. The return fluid flows up the drillstring, carrying with it sand, debris, and drill cuttings.

Reverse circulation forces the drilling fluid to flow through the relatively smaller inner diameter of the drillstring in returning to the surface as opposed to the larger annulus, and thus achieves greater fluid velocity. The faster speed enhances the debris suspension capabilities of the drilling fluid as compared to direct (forward) circulation. In particular, greater fluid velocity helps entrain and lift the debris more efficiently, which increases the overall cleaning efficiency or effectiveness of the operation for the well. This is true, however, only if the debris is suspended and loose within the wellbore. If the debris is consolidated and settled, reverse circulation may lose this advantage due to an inability to agitate the consolidated debris. Increasing the pressure differential of the reverse circulation may agitate some of the consolidated debris to be circulated out, but such increased pressures may also result in damage to the drillstring (coiled tubing) or in fluid losses into the subterranean formations surrounding the wellbore. Therefore, rotation of drillpipe is most often used to assist in dislodging settled debris.

In order to perform reverse circulation, the fluid has to be diverted from the annulus away from the drill bit and motor and into the drillpipe. Some tools that allow this redirection of flow into the drillpipe require the pumping of a ball downhole to block a passage in the fluid flow path, usually resulting in the shifting of some flow control device downhole to divert drilling fluid to the drillpipe. Such tools usually suffer from the disadvantage of not being returnable to full flow through the motor. Other such tools might employ a fracture disc or other release means, with these release means suffering from the same disadvantage of not being reversible, and thus incapable of more than a single use.

Consequently, there is a need for an improved tool which will reliably divert drilling fluid to the drillpipe to allow reverse circulation. The ideal tool will be simple, robust, and use only mechanical parts, obviating the need for wireline and other complexities, and allow repeated periods of reverse circulation without impeding forward flow.

SUMMARY OF THE INVENTION

One embodiment of the invention provides a weight activated sub to switch between forward circulation and reverse circulation when utilizing a motor for down hole operations. The tool comprises two nested cylinders in sliding cooperation. One cylinder couples to drillpipe above it, and the other to drillpipe below it. The tool is positioned in the drillpipe above the BHA and when the weight is on the drillpipe and the bit, the tool is closed so that fluid can only flow in the forward direction. When reverse flow is desired, the flow downhole is stopped, and the drillstring lifted slightly to take the weight off the bit. This allows the nested cylinders to partially separate, the lower shifting downward with gravity, exposing slots or holes in one of the cylinders-typically but not necessarily the inner—to allow fluid to enter the drillpipe. Once the fluid flow is reversed to be pumped into the annulus, instead of the drillpipe, reverse flow is achieved and fluid travel down the annulus, through the lots or holes and back up the drillpipe.

In yet another embodiment, the inner cylinder has an upside down J shaped slot in it, and the other cylinder has a protrusion that fits into the slot. Rotation and lifting of the drillstring will move the protrusion along the slot, moving the nested cylinder with it, thereby opening and closing the reverse flow path.

Although expressly designed for well cleanout during drilling, the tool can be used any time that reverse circulation is desired. For example, other uses may include spotting a variety of treatments: acids, lubricants, lost circulation materials, etc., and it could also be used for spotting fluids that are more or less dense than the primary cleanout fluid.

The invention comprises any one or more of the following embodiments in any combination(s) thereof:

A reverse circulator, having: a) an inner pipe having a first tool joint at a first end; b) an outer pipe having a second tool joint at a second end; c) two or more holes in one of the inner pipe or the outer pipe; and d) the outer pipe assembled around the inner pipe to form a nested pipe assembly such that the first and second tool joints are at opposite ends of the nested pipe assembly, and the inner pipe is slidingly fitted at least partially inside the outer pipe reversibly blocking the two or more holes.

Any reverse circulator herein described, the two or more holes preferably being in the inner pipe, although they can also be in the outer pipe. Preferably there are two or three holes equidistant and preferably the holes are slots big enough for cuttings, but not so large as to weaken the pipes too much. When slot shaped, the slot should be parallel with a long axis of the reverse circulator. Two holes or slots can be 180° apart, and 3 can be 120°, etc. A higher quality or thicker steel may be required to compensate for the holes. Internal vertical ridges on the inner pipe (e.g., on either side of the slots) may also be beneficial.

Preferably, any of the gravity driven reverse circulators are configured to prevent total separation, the inner pipe having an annular ridge on an exterior surface thereof at an end opposite the first tool joint, and the outer pipe further having an annular ridge on an interior surface thereof at an end opposite the second tool joint, such that the ridges cannot pass each other and the pipes cannot fully separate. The hook slot version could also have these ridges, but it probably will not be necessary as the protrusion in the slots prevents total separation.

Any reverse circulator herein described, the first and second tool joints being of differing sizes and thus obviating the need for any upset or jog in the pipes.

Any reverse circulator herein described, the first and second tool joint being of the same size and the inner pipe or the outer pipe or both having an upset therein.

Another embodiment of the reverse circulator, has: a) an inner pipe having a first tool joint at one end; b) an outer pipe having a second tool joint at one end; c) two or more hook-shaped slots in one of the inner pipe or the outer pipe, the slots oriented along a long axis of the inner pipe or the outer pipe and having a semi-circular curve at a top end of the slots; d) one of the outer pipe or the inner pipe having two or more protrusions on an inner surface near an upper end of the outer pipe or the inner pipe, the protrusions configured to fit into the slots; e) the outer pipe assembled around the inner pipe to form a nested pipe assembly such that the first and second tool joints are at a first and second end of the nested pipe assembly, the first end opposite the second end, and the inner pipe is slidingly fitted inside the outer pipe with the protrusions in the slots. In this embodiment, it may be preferred that the two or more slots being in the inner pipe and the two or more protrusions being on an inner surface of the outer pipe, but the reverse is also possible.

A method of reverse circulating in a well, the method having in order the following steps: a) providing a drillstring with any gravity driven reverse circulator herein described above a bottom hole assembly, typically near the bottom of the hole; b) forward pumping fluid down the drillstring with weight on the drillstring until reverse circulation is desired; c) ceasing the forward pumping; d) lifting the drillstring until the inner pipe and the outer pipe partially separate exposing the two or more holes; e) reverse pumping fluid down an annulus outside the drillstring without weight on the drillstring until forward circulation is desired; f) ceasing the reverse pumping; and g) repeating step b) or steps b-f) one or more times.

Another method of reverse circulating in a well, the method having the following steps in order: a) providing a drillstring with any hook shaped reverse circulator herein described in a closed position above a bottom hole assembly, the closed position being when the protrusions are at an upper terminus of the slots; b) forward pumping fluid down the drillstring with the reverse circulator in the closed position until reverse circulation is desired; c) ceasing the forward pumping; d) lowering and rotating the drillstring until the protrusion meets an uppermost portion of the curve, then lifting and rotating the drillstring so that the protrusions travel to a bottom terminus of the slots and the reverse circulator is in an open position; e) reverse pumping fluid down an annulus outside the drillstring with the reverse circulator in the open position until forward circulation is desired; f) ceasing the reverse pumping; g) lowering and rotating the drillstring until the protrusions travel to an uppermost portion of the curve, then rotating and lifting the drill string until the reverse circulator returns to the closed position; and h) repeating step b) or steps b-g) one or more times.

Any method herein described, wherein said method is performed during drilling to remove cuttings from said well. Any method herein described, wherein said method is performed to cleanout said well.

As used herein, wellbore "cleanout" refers to the removal of wellbore-fill material, such as sand, scale or organic materials, and other debris from the wellbore. Many reservoirs produce some sand or fines that may not be carried to surface in the produced fluid. Accumulations of fill material may eventually increase in concentration within the lower wellbore, possibly restricting production. Cleanouts using coiled tubing, snubbing or hydraulic workover techniques are performed routinely. The invention herein relates to tools (herein called a "reverse circulator") that allow reverse circulation for cleanout, but can be combined with any other suitable cleanout tools, such as wiper blades, baskets, and the like.

As used herein, "reverse circulation" for cleanout purposes is the intentional pumping of wellbore fluids down the annulus and back up through the drillpipe. This is the opposite of the normal direction of fluid circulation in a wellbore during drilling (Note: there are also reverse circulation drilling technologies available). Since the inside volume of the drillpipe is considerably less than the volume of the annulus outside of the drillpipe, reverse circulation can bring bottomhole fluids to the surface faster than normal circulation for a given flow rate and faster moving fluids are better able to carry debris to the surface. Synonyms include "back wash" and "reversing out."

As used herein to "pack off" is to plug the wellbore around a drillstring. This can happen for a variety of reasons, the most common being that either the drilling fluid is not properly transporting cuttings and carvings out of the annulus or portions of the wellbore wall collapse around the drillstring. When the well packs off, there is a sudden reduction or loss of the ability to circulate, and high pump pressures follow. If prompt remedial action is not successful, an expensive episode of stuck pipe can result. The term is also used in gravel packing to describe the act of placing all the sand or gravel in the annulus.

As used herein, the BHA or "bottomhole assembly" refers to the lower portion of the drillstring, consisting of (from the bottom up in a vertical well) the bit, bit sub, a mud motor (in certain cases), stabilizers, drill collar, heavy weight drillpipe, jarring devices ("jars"), and crossovers for various threadforms. The bottomhole assembly must provide force for the bit to break the rock (weight on bit), survive a hostile mechanical environment, and provide the driller with directional control of the well. Oftentimes the assembly includes a mud motor, directional drilling and measuring equipment, measurements-while-drilling (MWD) tools, logging-while-drilling (LWD) tools, and other specialized devices.

A "drillstring" is the combination of the drillpipe, heavy weight drillpipe, drill collar, centralizers, the bottomhole assembly, and any other tools used to make the drill bit turn at the bottom of the wellbore. The bit is not considered part of the drillstring.

As used herein, "drillpipe" is tubular steel conduit, typically fitted with special threaded ends called "tool joints." Drillpipe has two tool joints-a "box" female end and a "pin" male end. The drillpipe connects the rig surface equipment with the bottomhole assembly and the bit, both to pump drilling fluid to the bit and to be able to raise, lower and rotate the bottomhole assembly and bit.

The drill pipe can be categorized according to its upset area—the shape of pipe at the ends where the tool joint is added. The upset can be internal, external or internal-external upset, depending on the pipe diameter. In an internal upset, the required welding area thickness is provided by decreasing the pipe inside diameter at the upset area, the outside diameter remains the same. An external upset is provided by increasing the pipe outside diameter at the upset area, the inside diameter remains the same. In an internal-external upset, extra wall thickness at the upset area is reached by decreasing the inside diameter and increasing the outside diameter. These same upsets can be used in the tool of the invention so that the nested pipes can have the same size tool joint, although this is not essential and a larger drillpipe can be used above the tool than is used below.

"Tools joints" are the thickest and the strongest part of the drill pipe joints. They can be defined as pin-box connections with rounded threads, and they are manufactured separately from the drill pipe body and welded onto the upset area. There are different types of tool joints such as internal flush (IF), full hole (FH) and slim hole (SH).

As used herein, a "drill collar" is a heavier type of drillpipe used in a drillstring to add weight to the drill bit. They may be slick drill collars, with a smooth outer surface, or have a spiral groove on the outer surface that minimizes sticking to the formation. Sometimes, heavy weight drillpipe is used between drill collar and drillpipe to provide a smooth transition.

A "thread" is a helical or spiral ridge on a pipe, screw, nut, or bolt. Being "threaded" herein refers to spiral grooves on an inner surface of one device that is able to mate with a threaded exterior surface of another device. Most tool joints are threaded.

As used herein a "hole" in a pipe is a through-hole or gap in the pipe, allowing fluid to pass therethrough. A "slot" is a hole that is longer than it is wide and is oriented with the long axis of the pipe or tool in the reverse circulator.

A "hook-shaped slot" is the shape of a candy cane or walking cane, having a straight lower portion and a curved upper portion, usually a semi-circle. Either end may have a small offset or jog to allow for locking the tool.

As used herein an "upset" is a change in the diameter of a pipe, usually applied so that both ends of the nested pipes can be the same size and thereby use the same tool joints, yet the pipes can still nest together. Thus, the inner pipe may jog outward a bit so that its tool joint is the same size as the outer pipe tool joint. The reverse is also possible, wherein the outer pipe jogs a bit inward. See e.g., FIG. 1-4.

By industry standard, 0 degree inclination is vertical (downward pointing) and 90 degrees inclination is horizontal.

The use of the word "a" or "an" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim. The phrase "consisting of" is closed, and excludes all additional elements. The phrase "consisting essentially of" excludes additional material elements, but allows the inclusions of non-material elements that do not substantially change the nature of the invention, such as instructions for use, coatings, fasteners, and the like.

Any claim or claim element introduced with the open transition term "comprising," may also be narrowed to use the phrases "consisting essentially of" or "consisting of," and vice versa. However, the entirety of claim language is not repeated verbatim in the interest of brevity herein.

The following abbreviations are used herein:

| ABBREVIATION | TERM |
|---|---|
| BHA | Bottom Hole Assembly |
| FH | Full hole |
| IF | Internal flush |
| LWD | Logging-while-drilling |
| MWD | Measuring-while-drilling |
| SH | Slim hole |

BRIEF DESCRIPTION OF DRAWINGS

One embodiment of gravity-driven reverse circulator where the lower cylinder is interior to the upper, has holes, and moves with gravity.

Another embodiment of a gravity-driven reverse circulator with the hole in the outer cylinder.

Figure 2A:
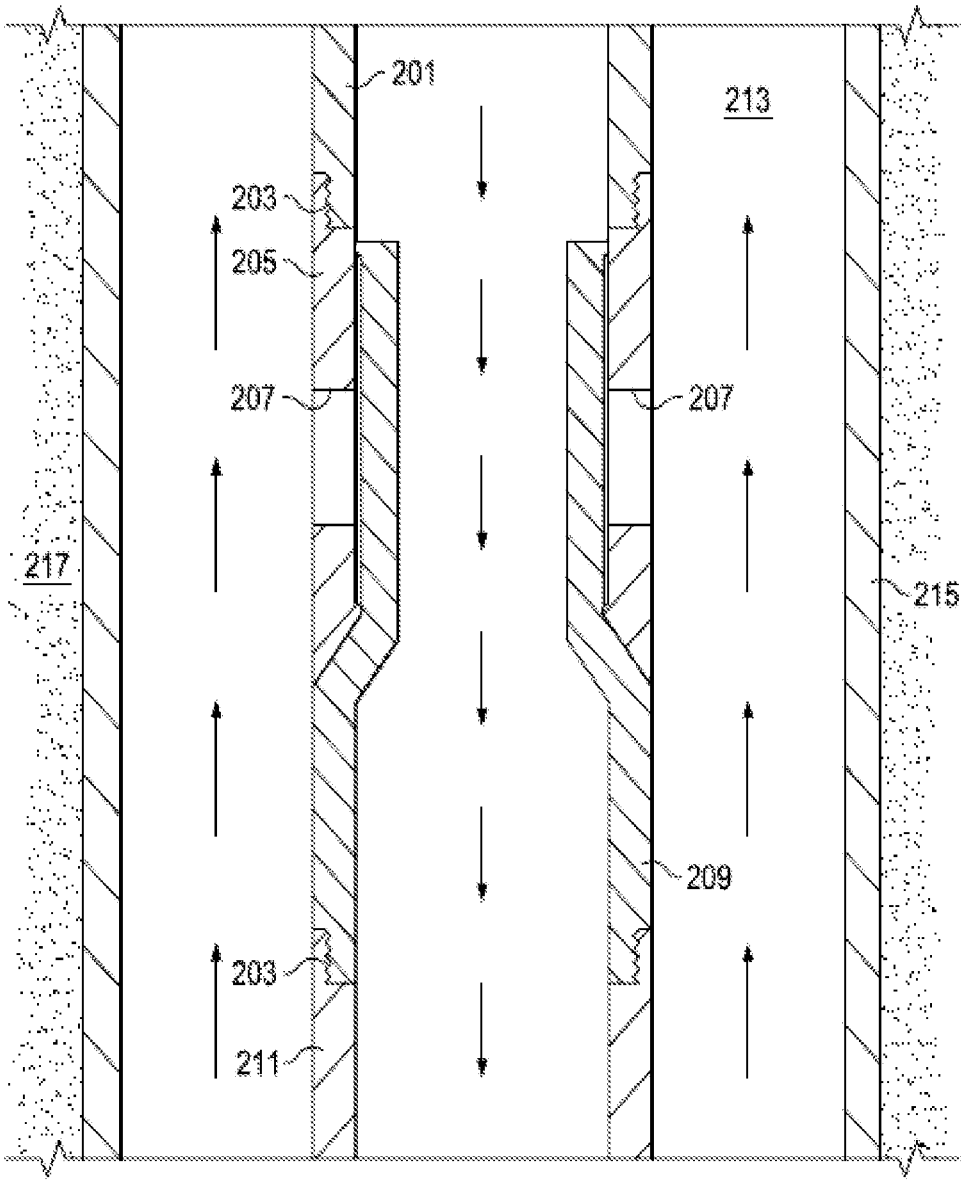

In FIG. 2A there is weight on the drill bit and the reverse circulator is closed.

FIG. 25 is weight off and reverse circulator open as lower interior cylinder falls in gravity.

Another embodiment of gravity-driven reverse circulator wherein the upper cylinder is interior and has the hole, and the lower exterior cylinder moves.

Figure 3A:
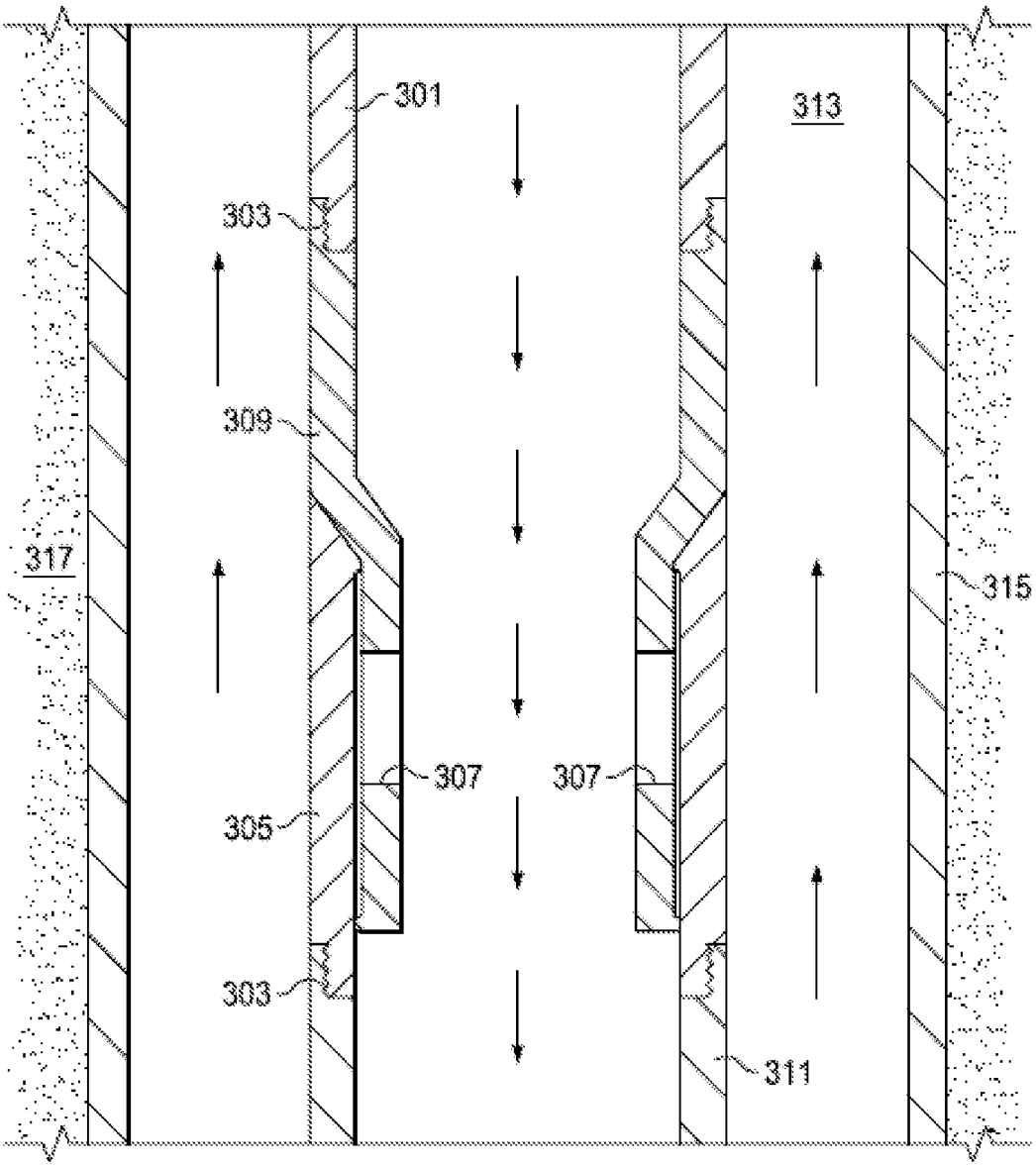

FIG. 3A weight on drill bit and reverse circulator closed.

Figure 3B:
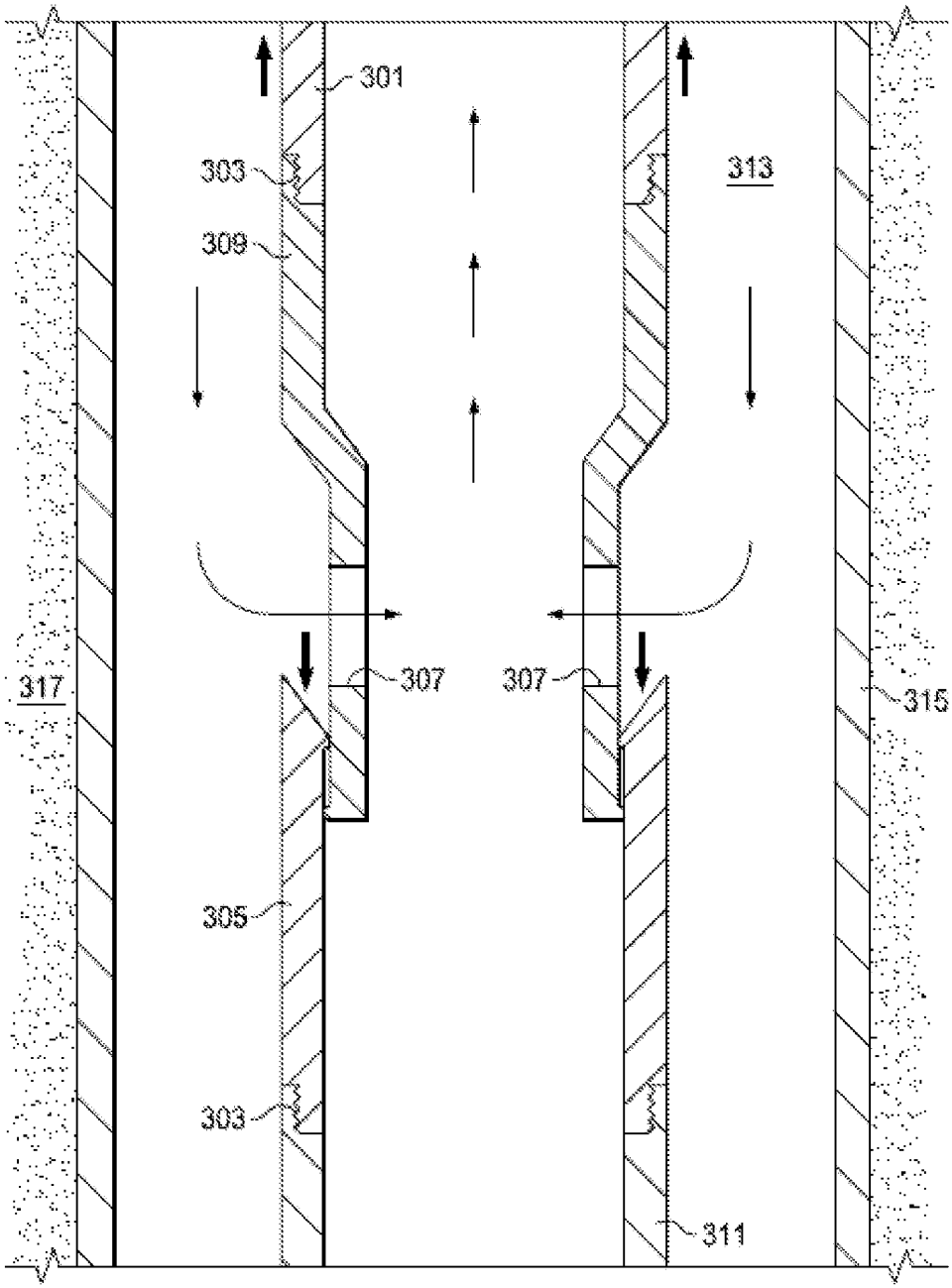

FIG. 3B weight off drill bit and reverse circulator open as the lower exterior sleeve fall in gravity.

Another embodiment of gravity-driven reverse circulator, like FIGS. 3A-3B but with the hole on the outer cylinder.

Figure 4A:
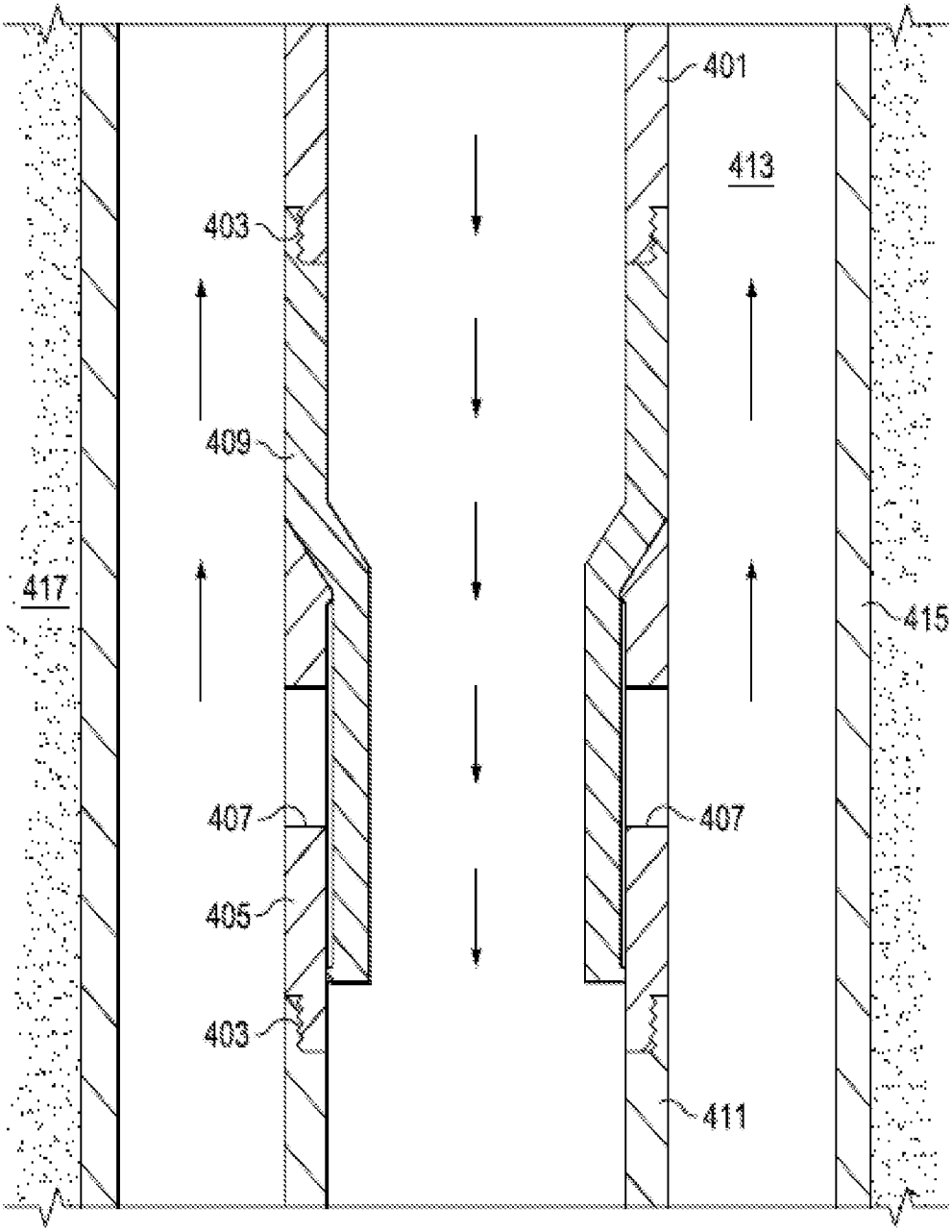

FIG. 4A weight on drill bit and reverse circulator closed.

FIG. 48 weight off drill bit and reverse circulator open as the lower exterior sleeve falls in gravity.

An embodiment of a hook slot reverse circulator that is gravity and rotation driven.

Figure 5A:
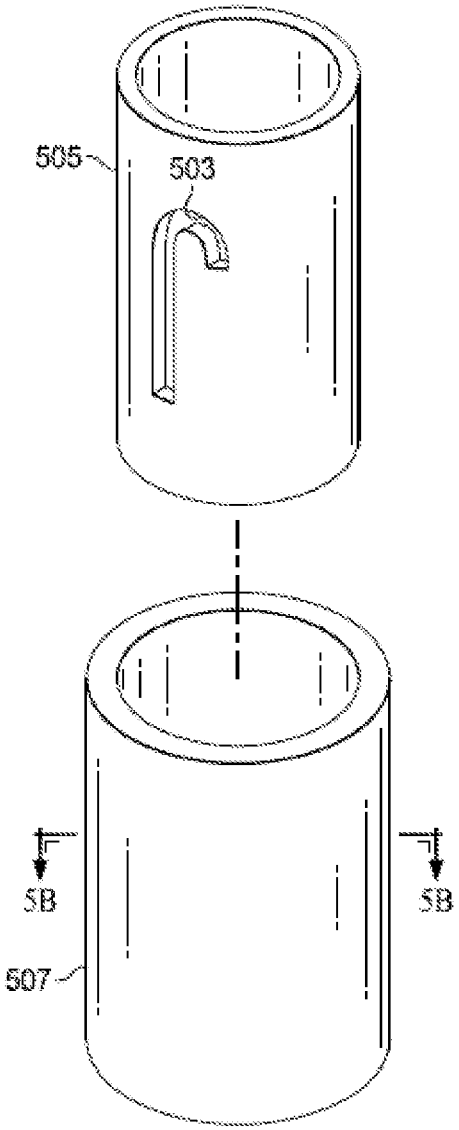

FIG. 5A shows the two main parts separately.

Figure 5B:
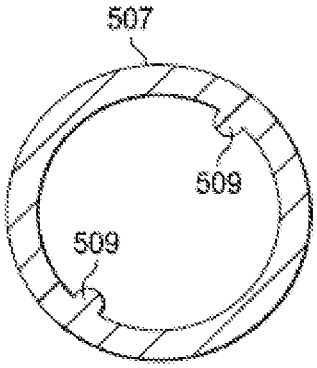

FIG. 5B is a cross section through line B-B showing the interior protrusion.

Figure 5C:
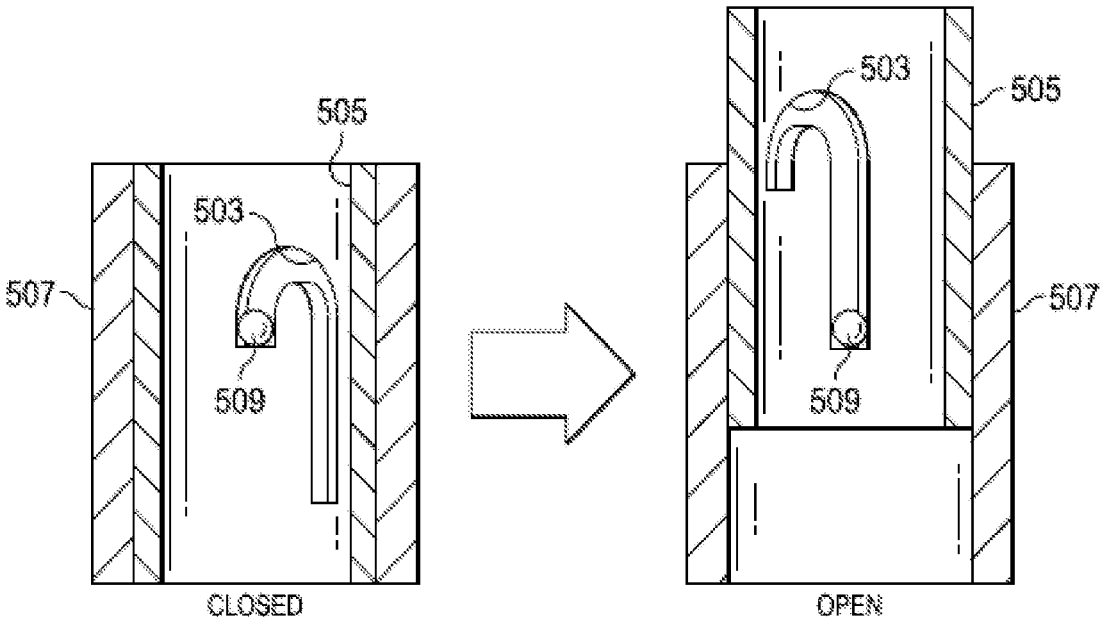

FIG. 5C shows the parts assembled in the closed (left) and open (right) positions.

Figure 6A:
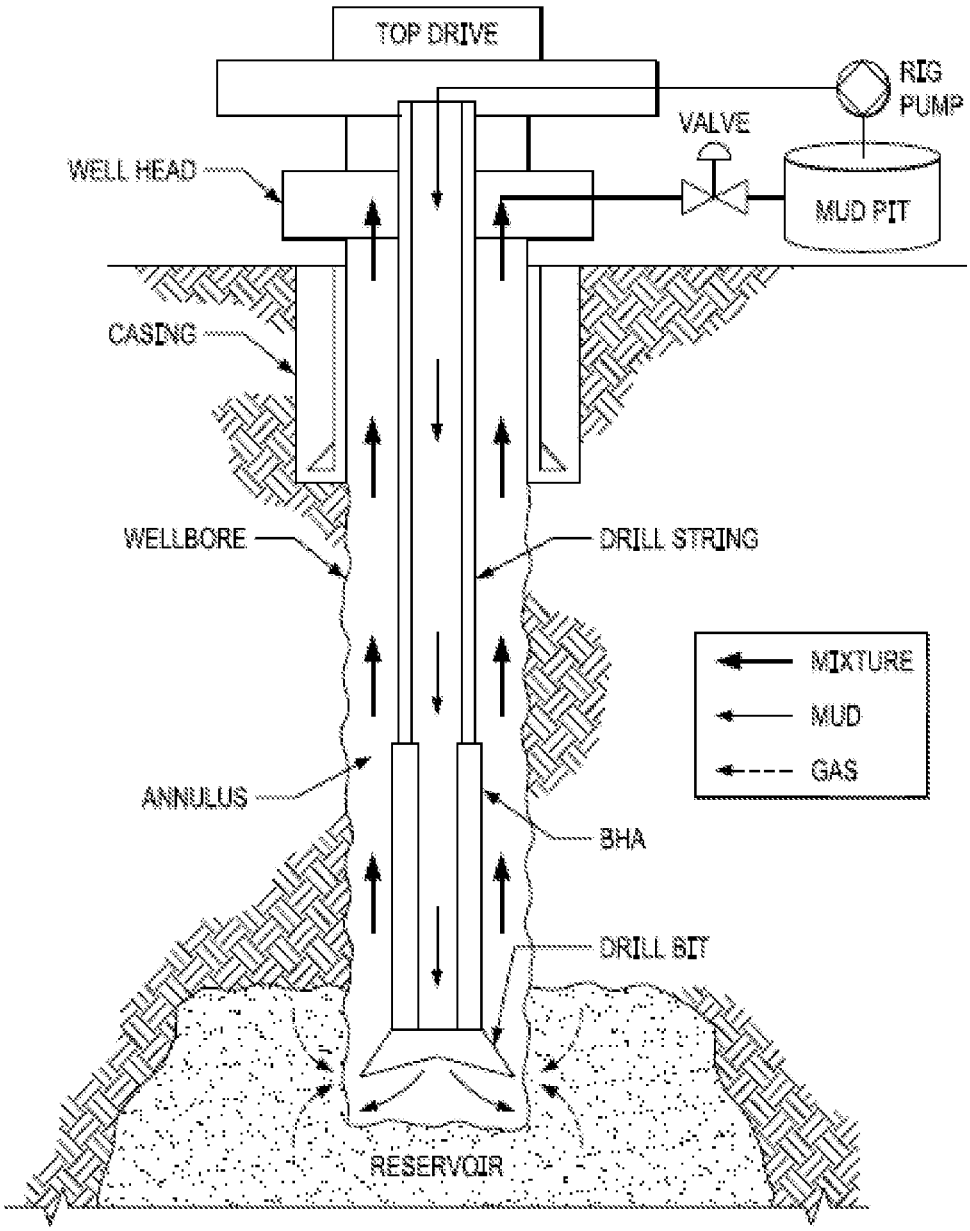
Figure 6B:
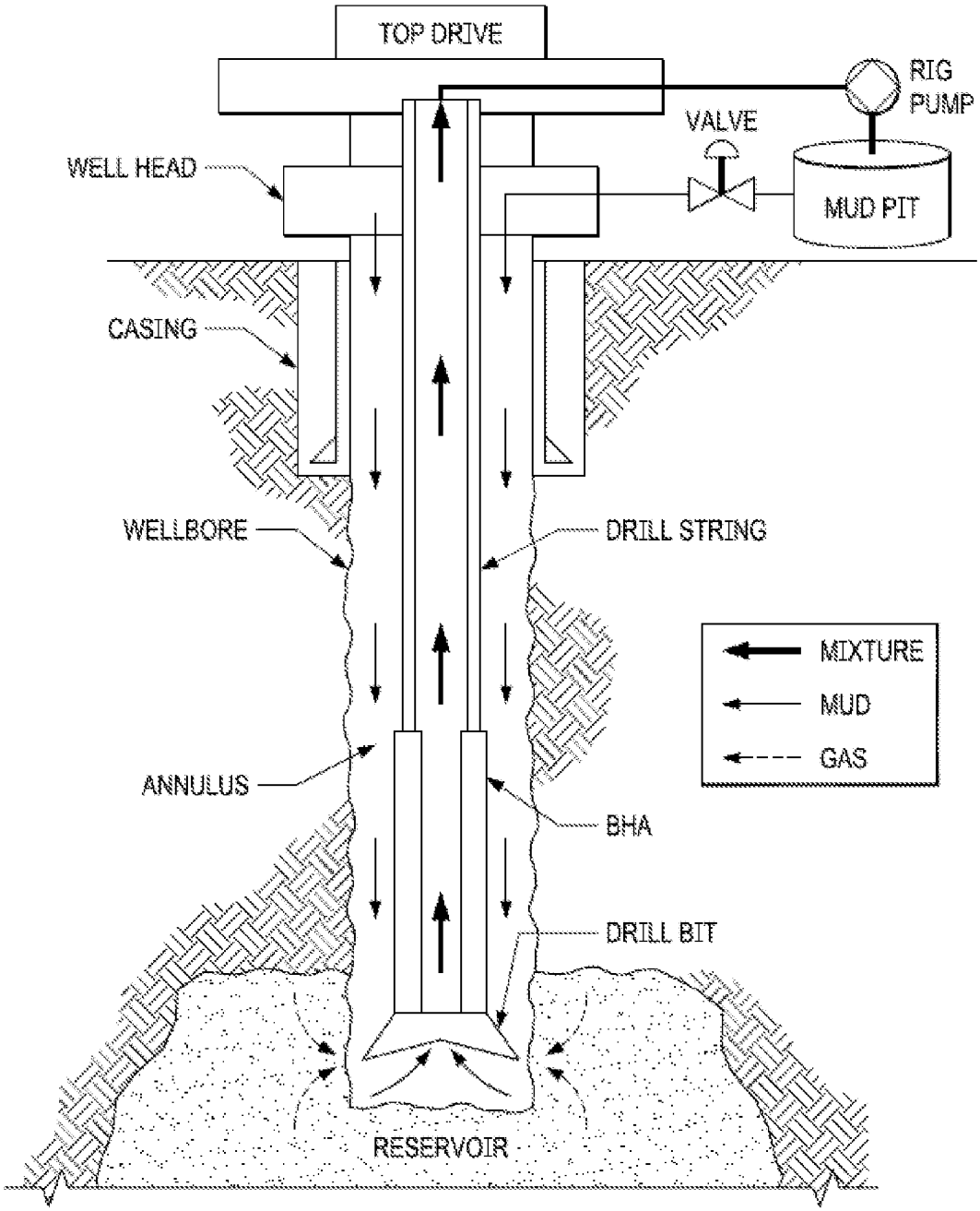

FIG. 6A is a schematic of the cased wellbore with drillstring bringing drilling fluid, usually mud to the BHA, thereby rotating the bit, and return flow up the annulus of the mixture of mud, cuttings and any escaping gas.

FIG. 68 shows reverse circulation, where fluid is pumped into the annulus, and returns up the drillpipe.

Figure 7:
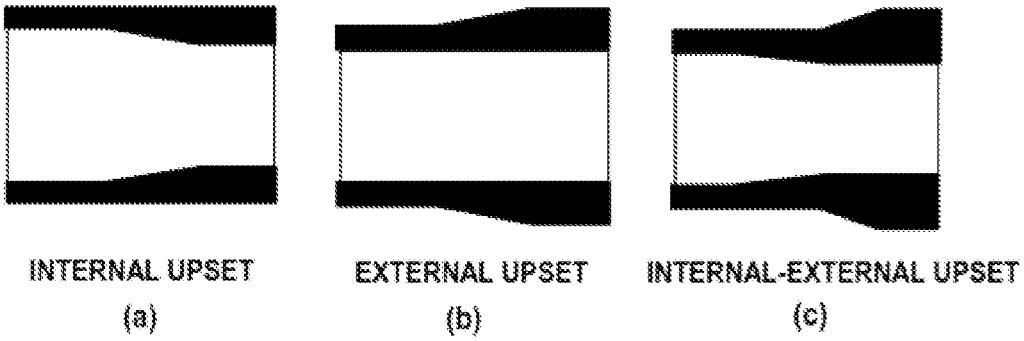

FIG. 7 show pipe upsets wherein inner or outer diameter changes to accommodate another device.

DETAILED DESCRIPTION OF THE INVENTION

The disclosure provides novel tools and methods for reverse circulating flow in a well, wherein flow can be reversed a multiplicity of times without sending tools or wire or other signals downhole.

Figure 1A:
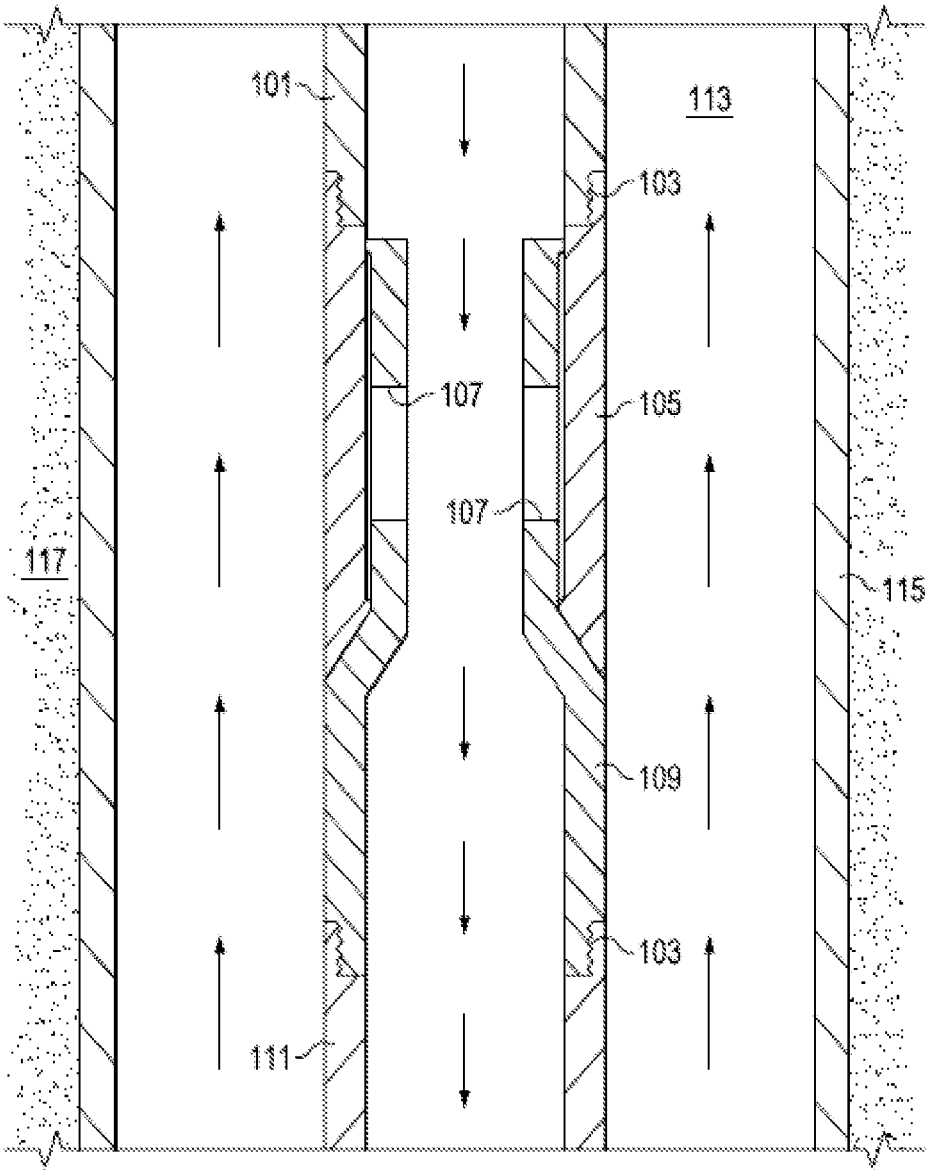
In FIG. 1A there is weight on drill bit and as a result the reverse circulator is closed.

FIG. 1A shows a lower portion of wellbore that is cased 115 and has drillpipe 101 and BHA (or drillpipe or other tool) 111 below (BHA not detailed herein). The reverse circulator tool is above the BHA 111 and comprises an interior pipe section 109 and an exterior pipe section or sleeve 105. Hole or slot 107 is shown in interior pipe 109, herein in the closed position. The pipe may have 1-6 holes or slots (preferably 2-3) arranged around its circumference depending on size of the tool. Also seen are threaded tool joints 103, but any tool joint could be used to couple the various components. Here the weight is on the drillpipe 101 and bit (not seen) so the weight holds the device closed, and fluid flow (arrows) is in the forward direction.

It is noted herein that the inner pipe has a jog or upset that allows both ends of the tool to have the same diameter. However, this can be optional where the drillstring about the BHA is of a slightly greater diameter than the drillpipe, tool or BHA below.

Figure 1B:
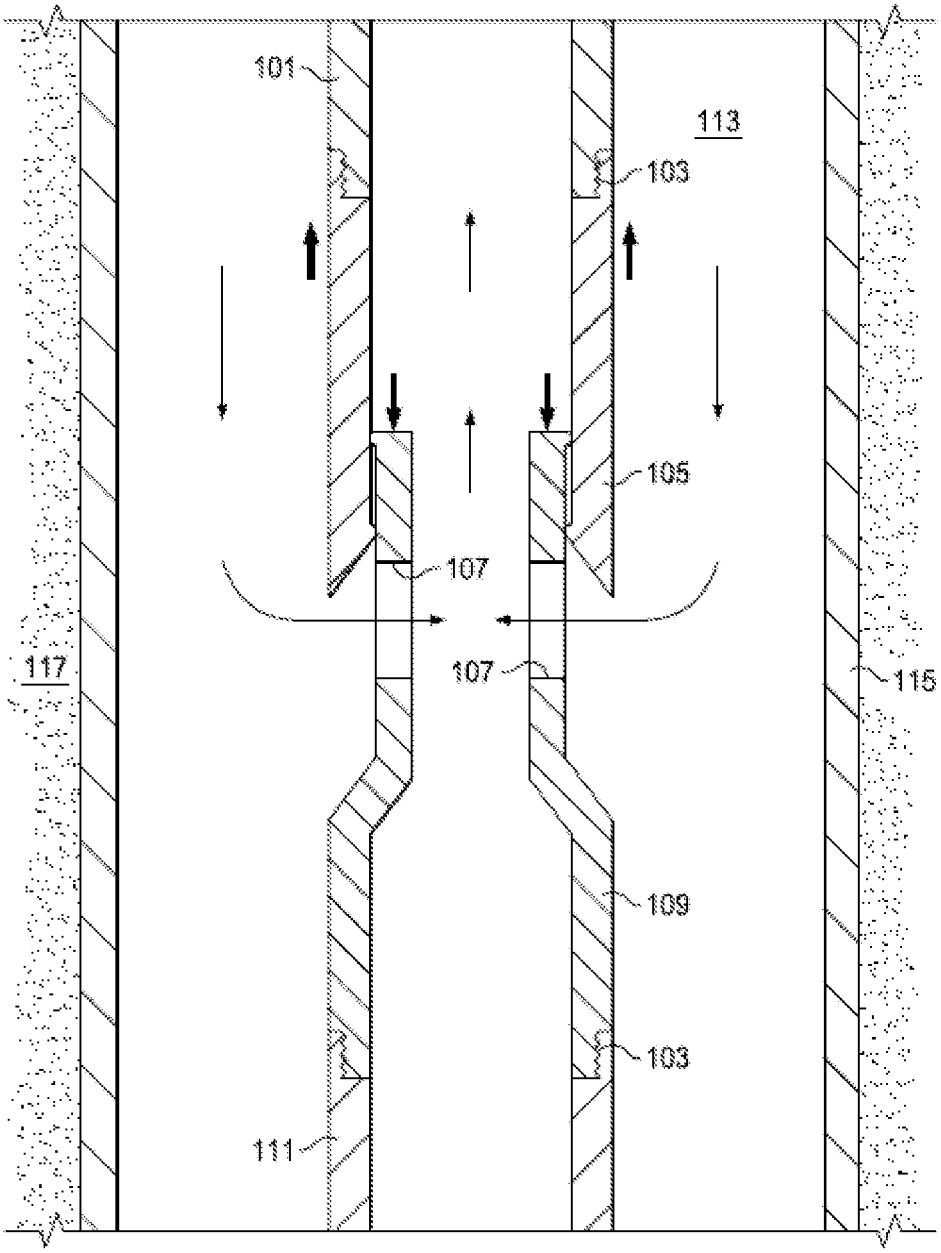
In FIG. 1B the drillstring is lifted such that weight is off drill bit and the reverse circulator opens as the lower interior cylinder falls in gravity.

In FIG. 1B, drilling fluid flow is stopped and the drillstring is lifted (heavy up arrow) and the weight of the tool in gravity allows the inner pipe 109 to slide down (heavy down arrow), thus opening the hole 107. Reverse circulation thus becomes possible by pumping fluid into the annulus 113. To again flow in the forward direction, reverse flow is stopped, weight applied to the bit, and fluid pumped into the drillpipe. This can be repeated as often as needed.

Figure 1C:
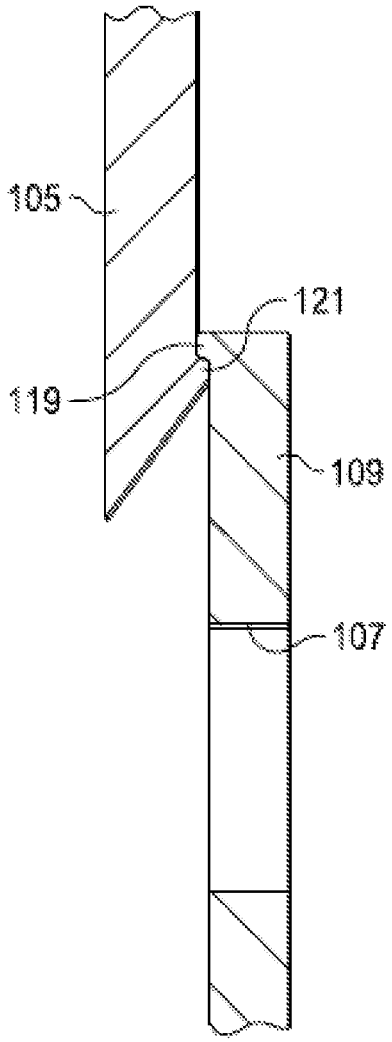
FIG. 1C is a close up of protrusions to prevent inner tube and outer sleeve from completely separating.

FIG. 1C shows a detail of the two ends of the outer pipe 105 and inner pipe 109 and small protrusions 119, 121 that prevent the parts from separating completely when pulling drillstring out of the hole. Separate protrusions around the circumference of the pipes are possible, but preferably, this is an annular ridge that circumnavigates the pipe and functions even when one pipe rotates with respect to the other.

Figure 2B:
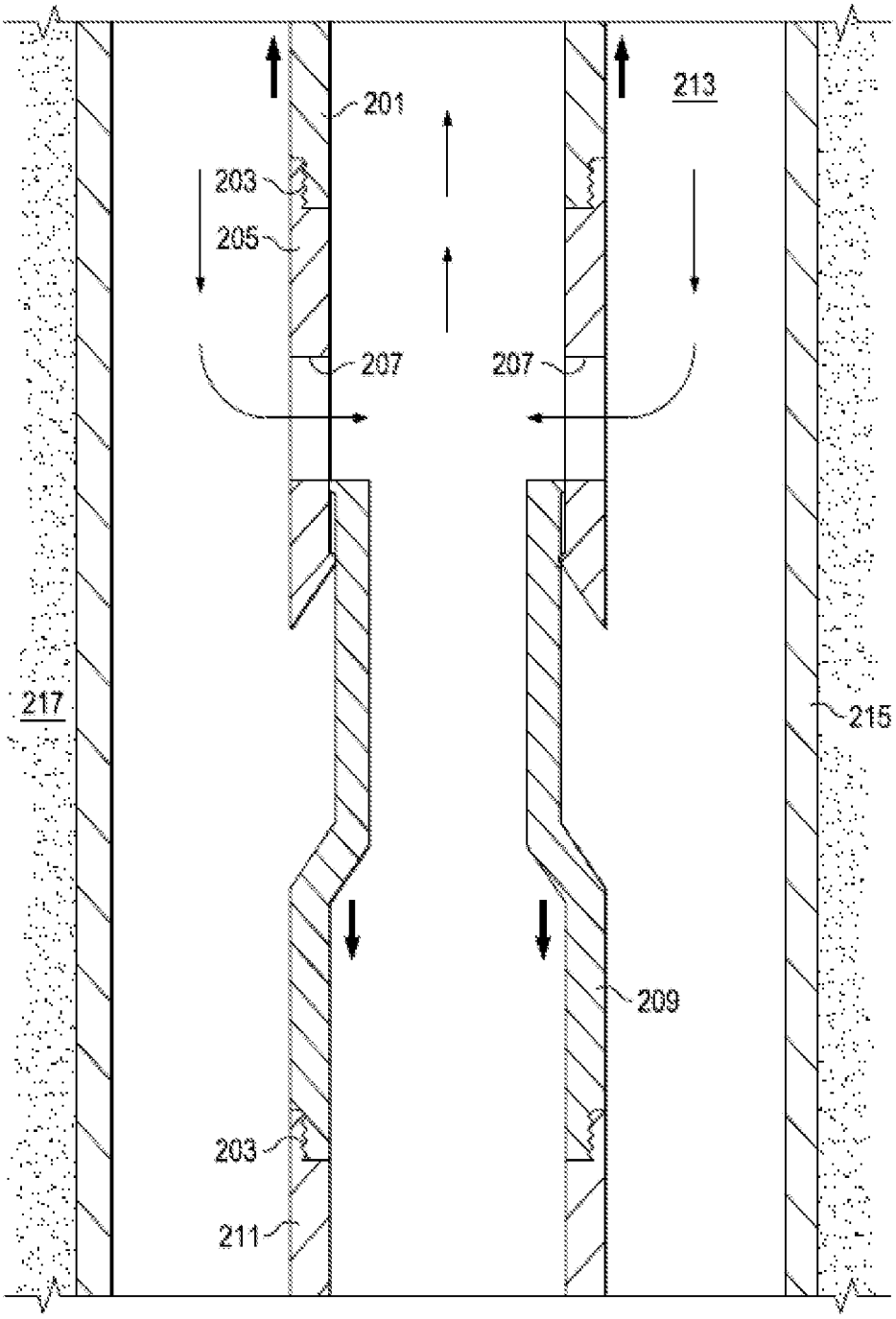

FIG. 2A-B is similar, and the numbering is the same except in the 200 series, and thus many parts are not discussed (e.g., 201, 203, 211, 213, 215, 217). Here hole 207 is on the outer pipe 205 instead of the interior pipe 209. We suspect that FIG. 1A may be the preferred embodiment, as the hole is protected from exterior debris while being deployed downhole.

Figure 4B:
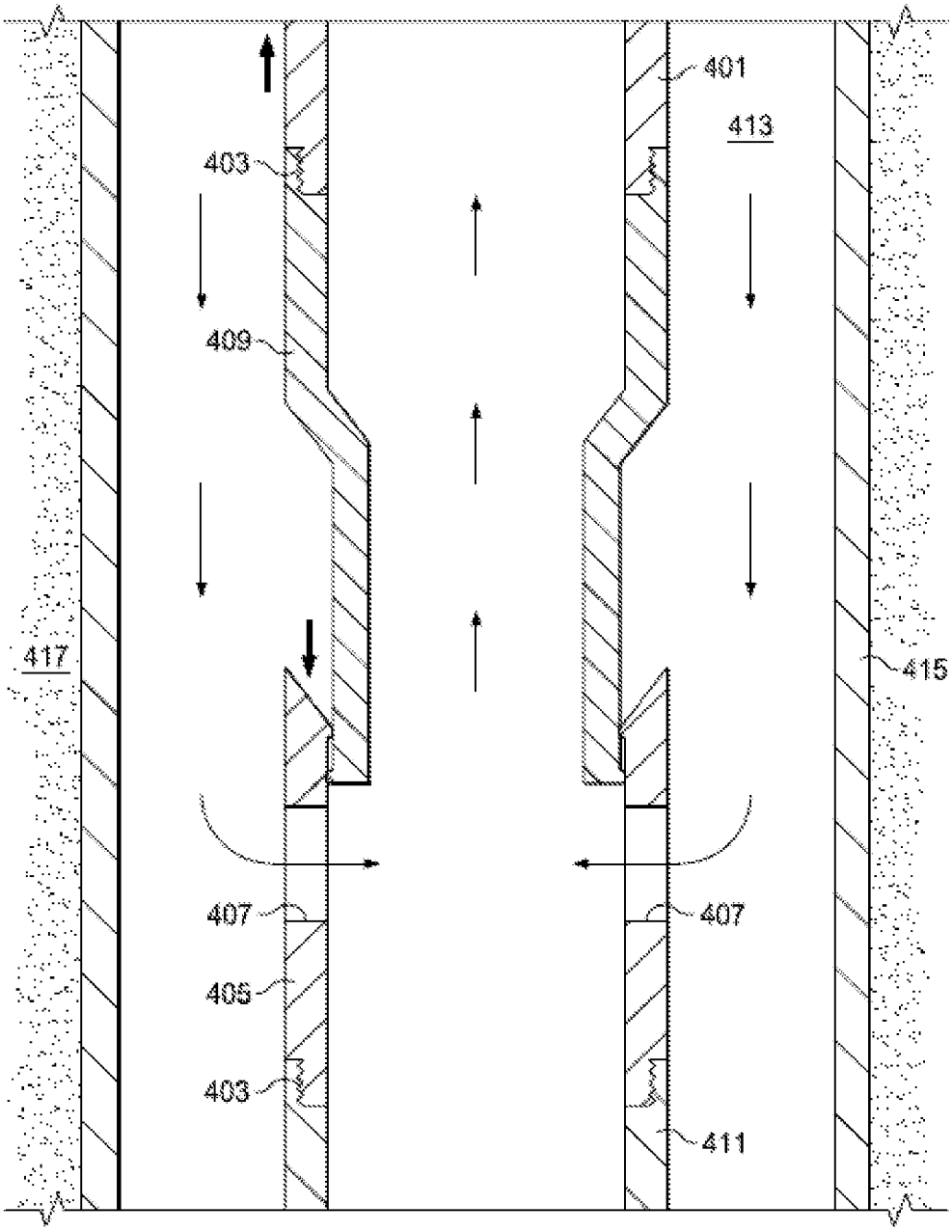

FIGS. 3A-B and 4A-B are like FIG. 1-2, but the couplings are reversed, the inner pipe 309 connecting to drillpipe 301 above the tool, instead of below the tool as in FIG. 1-2. In FIG. 4A-B the hole position is reversed as in FIG. 2. The numbering system is the same as FIG. 1, being 300 and 400 numbers. Since the parts are otherwise the same, they are not discussed again herein (e.g., 401, 303, 403, 305, 405, 307, 407, 409, 311, 411, 313, 413, 315, 415, 317, 417).

FIG. 5A shows a perspective view of the separate parts of a different embodiment of a gravity drive reverse circulator that requires both gravity and rotation to function. In this embodiment the inner pipe 505 has a hook slot 503. If desired a plurality of hook slots can circumnavigate the pipe. Here, there are two slots, though only one can be seen. The outer pipe or sleeve 507 is also seen, with line B-B providing a cross section seen in FIG. 5B. Here, two protrusions 509 are seen on the inner surface, and will fit into the two hook slots 503 when assembled such that the two pipes are nested.

FIG. 5C shows the parts assembled in the closed position (left) with protrusion 509 in slot 503 at the top end of the hook slot 503. To open the slots, the drillpipe is pushed down slightly, and rotated the width of the hook and then lifted, as shown in the right panel. Note that coupling details with pipe above and below are omitted for simplicity, but can be similar to that shown in FIG. 1-4. As with FIG. 1-4, it is possible to put the hook slot 503 on the outer pipe 507, instead of the inner pipe 505 and it is also possible to reverse the pipe joint orientation, giving 4 possible embodiments.

In this embodiment, the hook size and shape are such as to allow good fluid flow when open, and yet not so large that the tool cannot be compressed with the weight of the drillstring, small amount needed to pen the tool, nor so large that pipe integrity is threatened. If needed, a biasing force can be included in the tool to make this easier, but we do not expect to need this as fluid flow should act as a secondary shifting mechanism.

The following references are incorporated by reference in their entirety:

WO2014025797 Switchable fluid circulation tool.

U.S. Pat. No. 9,708,872 Clean out sub.

The invention claimed is:

1. A method of reverse circulating in a well, said method comprising:

a) providing a drillstring with a reverse circulator above a bottom hole assembly, said reverse circulator, comprising:

i) an inner pipe having a first tool joint at a first end, ii) an outer pipe having a second tool joint at a second end, iii) two or more holes in one of said inner pipe or said outer pipe, iv) said outer pipe assembled around said inner pipe to form a nested pipe assembly such that said first and second tool joints are at a first and second end of said nested pipe assembly, said first end opposite said second end, and said inner pipe is slidingly fitted at least partially inside said outer pipe and thereby reversibly blocking said two or more holes;

b) forward pumping fluid down said drillstring with weight on said drillstring until reverse circulation is desired;

c) ceasing said forward pumping;

d) lifting said drillstring until said inner pipe and said outer pipe partially separate exposing said two or more holes;

e) reverse pumping fluid down an annulus outside said drillstring without weight on said drillstring until forward circulation is desired;

f) ceasing said reverse pumping; and g) repeating step b) or steps b-f) one or more times.

2. The method of claim 1, said method further comprising rotating said drillstring during reverse pumping.

3. A method of reverse circulating in a well, said method comprising:

a) providing a drillstring with a reverse circulator in a closed position above a bottom hole assembly, said reverse circulator, comprising:

i) an inner pipe having a first tool joint at one end, ii) an outer pipe having a second tool joint at one end, iii) one or more hook-shaped slots in one of said inner pipe or said outer pipe, said slots oriented along a long axis of said inner pipe or said outer pipe and having a semi-circular curve at a top end of said slots, iv) one of said outer pipe or said inner pipe having one or more protrusions on an inner surface near an upper end of said outer pipe or said inner pipe, said protrusions configured to fit into said slots, and v) said outer pipe assembled around said inner pipe to form a nested pipe assembly such that said first and second tool joints are at a first and second end of said nested pipe assembly, said first end opposite said second end, and said inner pipe is slidingly fitted inside said outer pipe with said protrusions in said slots, said closed position being when said protrusions are at an upper terminus of said slots;

b) forward pumping fluid down said drillstring with said reverse circulator in said closed position until reverse circulation is desired;

c) ceasing said forward pumping;

d) lowering and rotating said drillstring until said protrusion meets an uppermost portion of said curve, then lifting and rotating said drillstring so that said protrusions travel to bottom terminus of said slots and said reverse circulator is in an open position;

e) reverse pumping fluid down an annulus outside said drillstring with said reverse circulator in said open position until forward circulation is desired;

f) ceasing said reverse pumping;

g) lowering and rotating said drillstring until said protrusions travel to an uppermost portion of said curve, then rotating and lifting said drill string until said reverse circulator returns to said closed position; and h) repeating step b) or steps b-g) one or more times.

* * * * *